US006050626A

United States Patent [19]

Dudley

[11] Patent Number: 6,050,626

[45] Date of Patent: Apr. 18, 2000

[54] MANUAL TRASH HARVESTER

[76] Inventor: James M. Dudley, 11484 Pine St., Jacksonville, Fla. 32258

[21] Appl. No.: 09/015,972

[22] Filed: Jan. 30, 1998

[51] Int. Cl.[7] ..... A01B 1/00; E01H 15/00

[52] U.S. Cl. ..... 294/61; 294/50; 224/219; 224/222

[58] Field of Search ..... 294/61, 50, 25, 294/19.1, 50.8, 50.9, 103.1, 1.1, 1.3; 224/219, 222, 184; 280/43, 37; 248/95; 15/257.1

[56] References Cited

U.S. PATENT DOCUMENTS

| | | | |
|---|---|---|---|
| 2,194,016 | 3/1940 | Geller | 43/6 |
| 2,575,189 | 7/1951 | Schmidt | 248/95 |
| 2,759,758 | 8/1956 | Yancey | 294/104 |
| 2,852,298 | 9/1958 | Tunstall, Sr. | 294/61 |
| 3,077,292 | 2/1963 | Gehrke | 224/184 |
| 3,806,146 | 4/1974 | Shaw | 284/95 |
| 4,190,920 | 3/1980 | Fikkers | 294/61 |
| 5,820,000 | 10/1998 | Tiimberlake et al. | 224/219 |

*Primary Examiner*—Dean J. Kramer
*Assistant Examiner*—Paul T. Chin
*Attorney, Agent, or Firm*—Arthur G. Yeager

[57] ABSTRACT

A manually-operated trash harvester system includes a trash retrieval assembly that consists of a rod with a spike on one end and a handle for a user's hand and an arm strap for the user's forearm at the other end and a movable tubular scraper mounted slidably over the rod and the spike. The scraper includes a flange for forcing impaled trash off the spike. The system also includes a trash collection assembly consisting of a trash bag frame mounted on wheels and includes four upstanding posts secured at the lower end thereof and movable to accommodate bags of various sizes in the interior space defined by the posts. A strap connects the bag frame to the user via a belt-like fastener to allow for hands-free movement of the collection assembly.

11 Claims, 3 Drawing Sheets

MANUAL TRASH HARVESTER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

BACKGROUND OF THE INVENTION

1. Field of the Invention

The present invention relates to manual trash spear devices and particularly to retractable spear devices and a container for retrieved trash.

2. Description of Related Art

A wide variety of trash spear devices are known to the prior art. Many of these devices employ complex spring-loaded telescoping spikes or prongs. Moreover, the devices in the prior art are cumbersome to use because the user grasps the device with one hand at one end of a pole. These devices are very tiresome if used for a substantial period of time. Finally, the devices of the prior art are not designed in a manner to be cooperatively used with an accompanying trash bag into which retrieved trash is placed. The present invention is designed to overcome all of these limitations.

BRIEF SUMMARY OF THE INVENTION

In one aspect of the present invention there is provided a manual trash harvester system comprising a trash retrieval assembly for grasping trash scattered on the ground and a trash collection assembly for holding trash retrieved, and releasable connection means for securing said trash collection assembly to the body of a user. The trash collection assembly includes a frame, a plurality of spaced wheels rotatably mounted to the frame and means to releasably secure a large trash bag on the frame generally within a vertical space defined by the wheels. Other aspects of the invention include the trash retrieval assembly having a rod having a spike means mounted on one end thereof for impaling trash thereon. The frame includes movable members formed as two inverted U-shaped portions, the vertical space in the frame to be of variable size. The movable members are moved, as by bending, to change the size of the vertical space to accommodate trash bags of a plurality of different sizes. The trash retrieval assembly further includes rejector means for removal of trash impaled on the spike. The rejector means includes a hollow tubular member slidably mounted over the rod and movable over the spike means and a flange mounted to the tubular member for forcing trash impaled on the spike means off the spike means. The rod and tubular member each include a respective handle to provide for relative movement between the rod and the tubular member for permitting impaling of trash on the spike means when the handles are adjacent each other and removal of impaled trash when the handles are moved remotely of each other.

At least one said handle includes spacer means mounted thereon to limit the minimum distance allowable between the handles to minimize a user's hand being pinched between the handles when using the trash retrieval assembly.

The invention further includes means for securing the trash retrieval assembly to an arm of a user. The strap means includes adjustable length fastener means for adapting the strap to user's arm of different sizes.

In other aspects of the present invention there is provided a manual trash harvester system comprising a trash grasping assembly for retrieving trash scattered on the ground and a trash collection assembly for holding trash retrieved. The trash grasping assembly includes an elongated rod having a handle adjacent an upper end portion thereof and a spike mounted on a lower end portion thereof. A tubular sleeve is included and has a handle at one end portion thereof and a circular flange at the other end portion thereof. The sleeve is mounted to be slidably and telescopingly disposed over the rod and is sized shorter in length than the rod to expose the spike when the handle of the sleeve and the handle of the rod are in proximity. The flange has an opening for passage of the spike therethrough and a surface to force trash impaled on the spike off the spike when the sleeve is moved over the spike. The trash collection assembly includes a movable frame having a top portion and a bottom portion including a plurality of spaced upstanding post members defining a vertical space in the frame open at the top portion for supporting a trash collection bag within said space. The frame further includes spaced wheels for movement of the frame over ground. The upstanding post members each have an upper end portion and a lower end portion. The upper end portion is movable inwardly and outwardly with respect to the interior space to support a plurality of sizes of trash collection bags. The rod includes an arm strap mounted on the upper end portion thereof for securing the upper end portion to the arm of a user. The arm strap includes an adjustable length fastener means for securing the strap securely to arms of various sizes.

The system further includes connection means having opposite end portions, one of which is attached to the frame of the trash collection assembly and the other adapted for attachment around the waist of a user. The end portion of the connection means attached to the frame is attached to the bottom portion of the frame.

Other features of the invention include plastic attachment means mounted on the upper end portion of the rod for hanging of the trash grasping assembly by a hook when not in use. In addition, the upper end portion of the rod and the tubular sleeve are formed of plastic.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
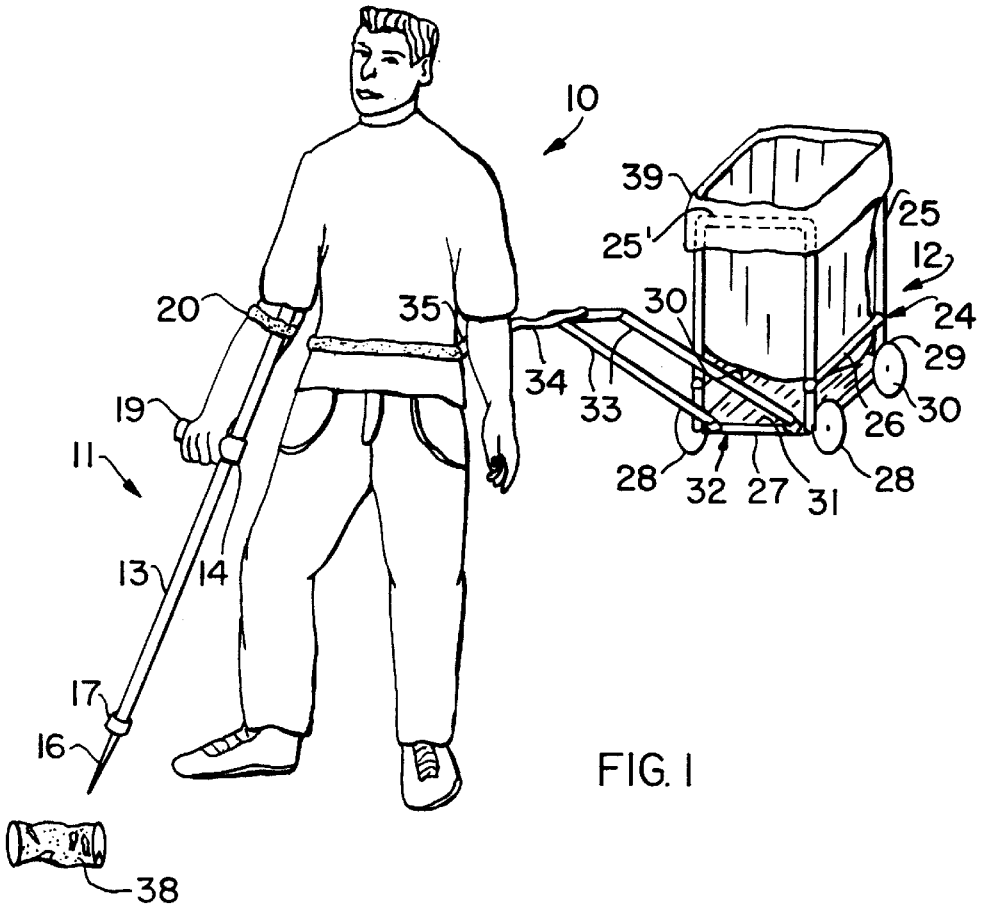
FIG. 1 is a pictorial view of the trash collection system according to the present invention as it appears in use.
Figure 2:
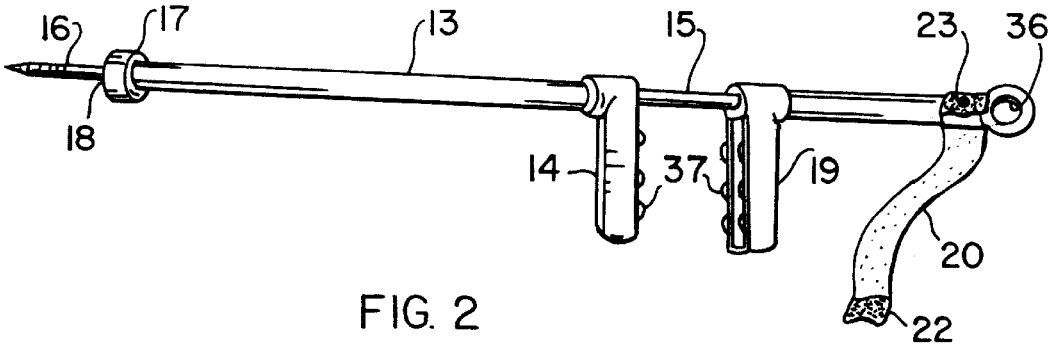
FIG. 2 is a side perspective view of the trash grabber of FIG. 1.

With reference now to the drawings, the manual trash collecting system is illustrated at numeral 10 in FIG. 1 and is comprised of a trash retrieval grasping assembly or grabber 11 and a trash carrier or collection assembly 12. Trash grabber 11 includes a slidably movable plastic tubular outer sleeve 13 mounted over an inner hollow rod 15 (see also FIG. 2). Outer sleeve 13 has a handle 14 and a scraper 17 designed to push against trash that is impaled on spike 16. Spike 16 is mounted on the end of inner rod 15 by inserting it into a plug (not shown) that is held in place by adhesive and the crimping of rod 15. Inner rod 15 has a handle 19 and a strap 20 that fits around a user's forearm. Fastener 21 includes Velcro hooks 22 and fluff 23 although other adjustable length fastener means can be used. Can 38 represents trash which is deposited in bag 39.

Trash collector 12 includes a frame 24 of four upright PVC post members 25 connected at the lower portion thereof by two horizontal post members 26 to define an interior vertical space. The posts 25 are connected at the top by front and rear horizontal members 25'. The front member 25' is shown in broken lines in FIG. 1. The members 25 and 25' are made of PVC and form two inverted U-shaped portions that provide continuous support for the front and rear outwardly folded edges of the bag 39. A front axle 27 and rear axle 29 have respective pairs of wheels 28 and 30. Mesh member 31 fits over the rectangular lower part 32 of frame 24 and serves as a storage support for folded plastic trash bags. Yoke 33 connects trash collector 12 to the user belt loop 35 via a connecting strap 34.

The construction of frame 12 provides for inward and outward flexibility of post members 25 so as to accommodate a wide variety of sizes of bag 39.

Figure 3:
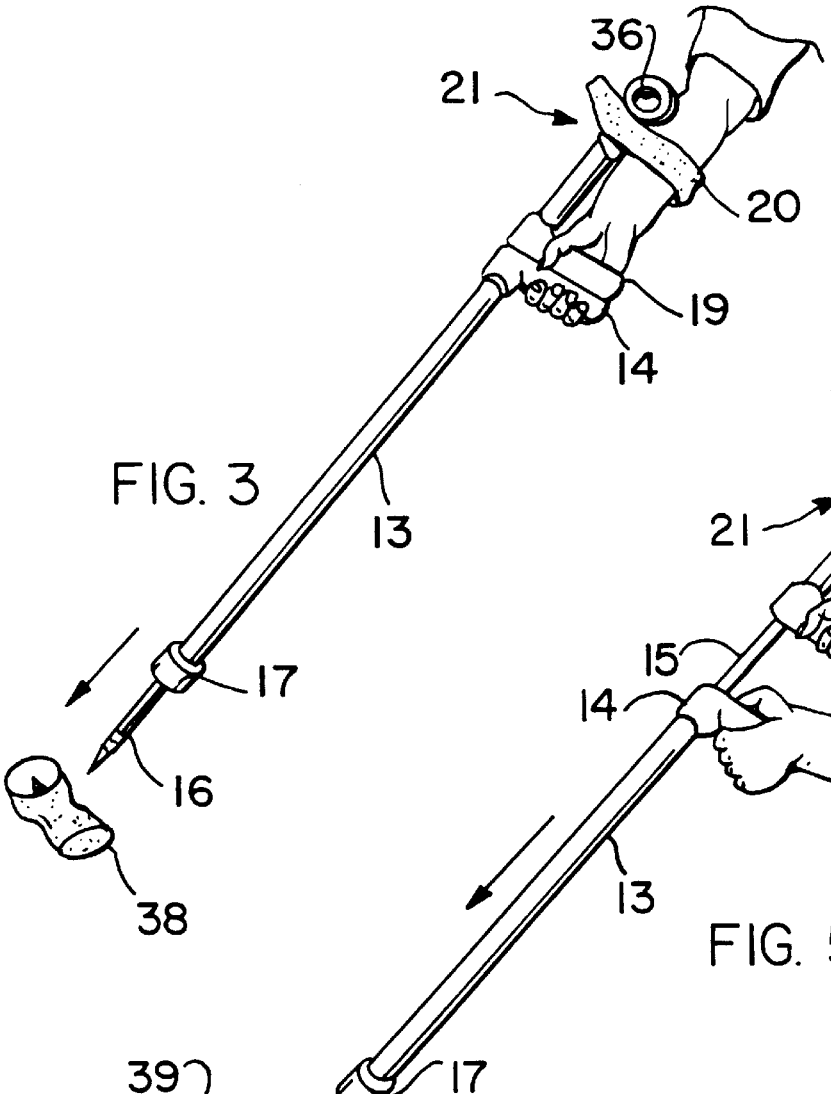
FIGS. 3–5 are partial pictorial views of the system of FIG. 1 as it is operated.

In an embodiment of the system 10 a plastic hanger loop 36 is included on the plastic top portion of inner rod 15 for hanging the device by a hook (not shown) and spacers 37 are used to prevent handles 14 and 19 from being squeezed to close together (FIG. 3).

Figure 6:
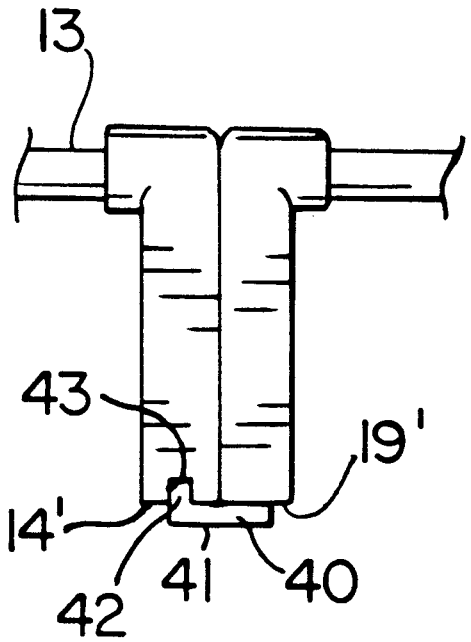
FIG. 6 is a partial side elevational view of the handles locked together.
Figure 7:
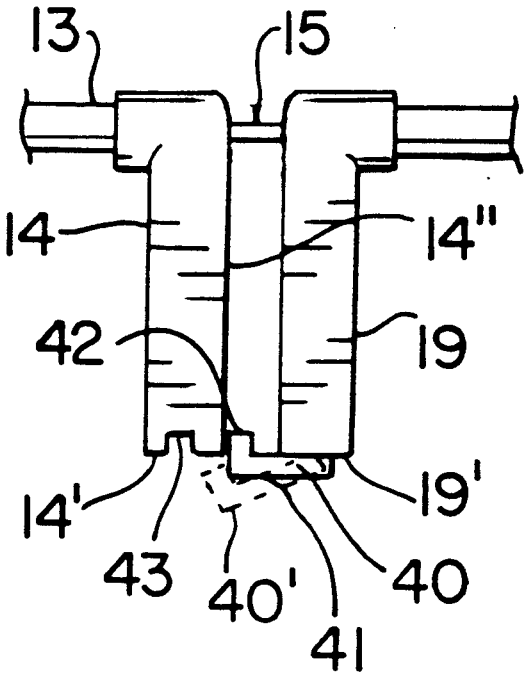
FIG. 7 is a view similar to FIG. 6 showing the handles unlocked.

The spacers 37 are not preferred because of the use of a spacer means in the form of an L-shaped foot 40 attached to one of the handle members 14, 19 (herein shown in FIGS. 6 and 7 as being attached to member 19). Spacer foot 40 includes an elongated element 41 having one end attached to the end 19' of member 19 and a lateral flange element 42 which contacts the face 14" of handle member 14 with normal use of the trash retrieval assembly 11. Also, the spacer foot 40 is resilient and may be temporarily bent, as shown by broken lines 40' in FIG. 7; outwardly away from end 19' and end 14' of member 14 to permit the lateral flange element 42 to enter slot 43 in the end 14' of member 14 to secure the handle members 14 and 19 together for storage and the like as shown in FIG. 6.

Figure 5:
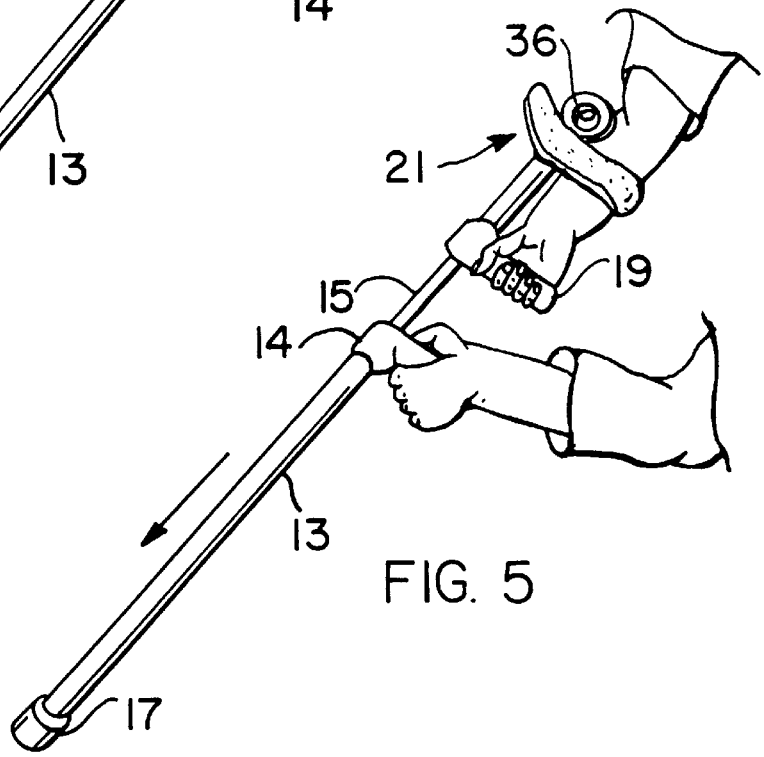
Figure 4:
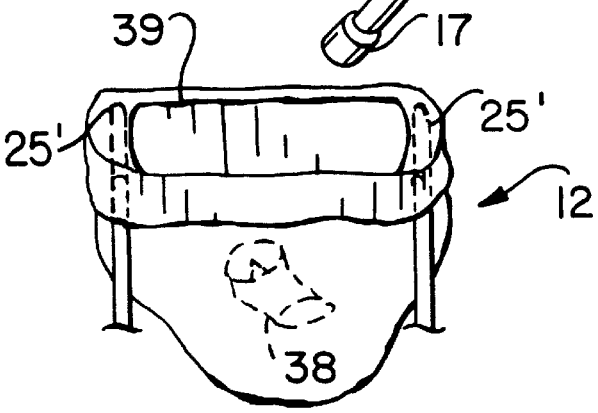
Figure 4:
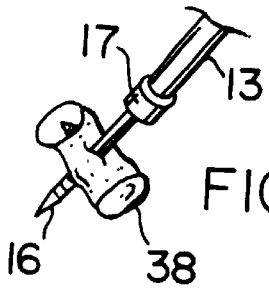

The operation of the system 10 can be discussed with reference to FIGS. 3–5.

FIG. 3 illustrates the one-handed use of the system 10 to spear trash or a can 38. The use of strap 20 provides good leverage and control of the trash grasping assembly 11 by taking much of the weight and pivot action of the assembly 11 off of the user's wrist. With the can 38 impaled on spike 16 (FIG. 4), the can 38 is pushed off spike 16 and into bag 39 by downward movement of scraper 17 which is attached to outer sleeve 13 (FIG. 5). It is to be understood that the bag 39 is located at a predetermined distance from the user approximately the length of the assembly 11 to minimize unnecessary steps by the user in depositing the speared trash into the bag 39. In addition, the top of bag 39 is approximately the same height as the waist of the user. FIG. 5 shows an exaggerated height differential for purposes of illustration.

The use of yoke 33 and belt 35 connected via strap 34 provides a hands-free movement of collection assembly 12 as the user moves over the area to by cleaned.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A manual trash harvester system comprising a trash grasping assembly for retrieving trash scattered on the ground and a trash collection assembly for holding trash retrieved, said trash grasping assembly including an elongated rod having a handle spaced from and adjacent an upper end thereof and a spike mounted on a lower end thereof, a round tubular sleeve having a handle at one end thereof and a circular flange at the other end thereof, said sleeve being slidably and telescopingly disposed over said rod, said sleeve being shorter in length than said rod to expose said spike when said handle of said sleeve and said handle of said rod are in proximity and gripped by a hand of a user, said flange having an opening for passage of said spike therethrough and a surface to force trash impaled on said spike off said spike when said sleeve is moved over said spike, said rod having an elongated portion between its said handle and said upper end which extends along a user's forearm when said handles are gripped by a hand of a user.

2. The system as defined in claim 1 wherein said rod includes an arm strap mounted on said elongated portion for securing said elongated portion to an arm of a user, said arm strap including adjustable length fastener means for securing said strap securely to arms of various sizes.

3. The system as defined in claim 1 further including an L-shaped foot attached at one end thereof to one said handle and having a flange engageable with another said handle during normal use of said handles toward and away from each other, said another handle having a slot therein engageable by said flange to releasably lock said handles together during non-use of said handles.

4. The system as defined in claim 1 further comprising spacer means to prevent said handles from pinching a user's hand when both said handles are held closely together with one hand of a user.

5. The system as defined in claim 1 further including attachment means mounted on said elongated portion of said rod for hanging of said trash grasping assembly by a hook when not in use.

6. In a manual trash harvester system comprising a trash retrieval assembly for retrieving trash scattered on ground, said assembly comprising an elongated round rod having a handle spaced from and adjacent an upper end thereof and a spike mounted on a lower end thereof, a round tubular sleeve having a handle at one end thereof and a circular flange at the other end thereof, said sleeve being slidably and telescopingly disposed over said rod, said sleeve being shorter in length than said rod to expose said spike when said handle of said sleeve and said handle of said rod are in proximity and gripped by a hand of a user, said flange having an opening for passage of said spike therethrough and a circular surface to force trash impaled on said spike off said spike when said sleeve is moved over said spike, and spacer means to limit the minimum distance allowable between said handles to minimize injury to a hand of a user.

7. The assembly as defined in claim 6 wherein said spacer means includes an L-shaped foot attached at one end thereof to one said handle and having a flange engageable with another said handle during normal use of said handles, said another handle having a slot therein engageable by said flange to releasably lock said handles together.

8. The assembly as defined in claim 6 further comprising an arm strap mounted on said rod above said handles for securing to an arm of a user adjacently below an elbow.

9. The assembly as defined in claim 6 further comprising attachment means mounted on said rod above said handles for hanging said assembly by a hook when not in use.

10. The assembly as defined in claim 6 wherein said spacer means engages between said handles.

11. The assembly as defined in claim 6 further comprising attachment means mounted on said rod above said handles for hanging said assembly by a hook when not in use, and an arm strap mounted on said rod above said handles for securing to an arm of a user adjacently below an elbow, said strap having adjustable length fastener means for securement to various sizes of arms.

* * * * *